US005399099A

United States Patent [19]

English et al.

[11] Patent Number: 5,399,099

[45] Date of Patent: Mar. 21, 1995

[54] EMI PROTECTED TAP CONNECTOR

[75] Inventors: James M. English, Annville; John C. Farrar, Harrisburg, both of Pa.

[73] Assignee: The Whitaker Corporation, Wilmington, Del.

[21] Appl. No.: 105,540

[22] Filed: Aug. 12, 1993

[51] Int. Cl.[6] ..... H01R 4/24

[52] U.S. Cl. ..... 439/417; 439/404

[58] Field of Search ..... 439/395, 417, 404, 411, 439/622, 621, 620

[56] References Cited

U.S. PATENT DOCUMENTS

| | | | |
|---|---|---|---|
| 3,649,955 | 3/1972 | Schmidt et al. | 339/99 L |
| 3,706,066 | 12/1972 | Shroyer . | |
| 4,120,555 | 10/1978 | Shiflett et al. | 339/126 R |
| 4,153,326 | 5/1979 | Frantz et al. | 339/99 R |
| 4,356,532 | 10/1982 | Donaher et al. | 361/393 |
| 4,371,226 | 2/1983 | Brancaleone | 339/147 R |
| 4,376,922 | 3/1983 | Muzslay | 333/182 |
| 4,500,159 | 2/1985 | Briones et al. | 339/147 R |
| 4,519,665 | 5/1985 | Althouse et al. | 339/147 R |
| 4,580,866 | 4/1986 | Hagner | 339/147 R |
| 4,582,385 | 4/1986 | Couper et al. | 339/147 R |
| 4,600,256 | 7/1986 | Anttila | 339/17 M |
| 4,600,262 | 7/1986 | Nieman et al. | 339/147 R |
| 4,606,598 | 8/1986 | Drzymkowski et al. | 339/147 R |
| 4,660,907 | 4/1987 | Belter | 339/14 R |
| 4,690,479 | 9/1987 | Hollyday et al. | 439/97 |
| 4,695,115 | 9/1987 | Talend | 439/76 |
| 4,707,048 | 11/1987 | Gilha et al. | 439/620 |
| 4,707,049 | 11/1987 | Gilha | 439/620 |
| 4,726,638 | 2/1988 | Farrar et al. | 439/620 R |
| 4,726,790 | 2/1988 | Hadjis | 439/620 |
| 4,729,752 | 3/1988 | Dawson, Jr. et al. | 439/620 |
| 4,772,221 | 9/1988 | Kozlof | 439/549 |
| 4,772,224 | 9/1988 | Talend | 439/607 |
| 4,772,225 | 9/1988 | Ulery | 439/620 |
| 4,781,624 | 11/1988 | Shepherd | 439/620 |
| 4,789,360 | 12/1988 | Paul et al. | 439/620 |
| 4,797,120 | 1/1989 | Ulery | 439/578 |
| 4,804,332 | 2/1989 | Pire | 439/620 |
| 4,820,191 | 4/1989 | Lacroix | 439/402 |
| 4,826,449 | 5/1989 | Debortoli et al. | 439/417 |
| 4,846,732 | 7/1989 | Meelhuysen | 439/620 |
| 4,880,397 | 11/1989 | Dawson, Jr. et al. | 439/620 |
| 4,884,982 | 12/1989 | Fleming et al. | 439/620 |
| 4,929,196 | 5/1990 | Ponn et al. | 439/620 |
| 4,930,200 | 6/1990 | Brush, Jr. et al. | 29/25.42 |
| 4,934,960 | 6/1990 | Capp et al. | 439/620 |
| 4,950,185 | 8/1990 | Boutros | 439/620 |
| 4,954,794 | 9/1990 | Nieman et al. | 333/182 |
| 4,992,061 | 2/1991 | Brush, Jr. et al. | 439/620 |
| 4,993,966 | 2/1991 | Levy | 439/411 |
| 5,018,989 | 5/1991 | Black et al. | 439/620 |
| 5,019,795 | 5/1991 | Patel et al. | 335/205 |
| 5,057,041 | 10/1991 | Yu et al. | 439/620 |

(List continued on next page.)

*Primary Examiner*—Daniel W. Howell
*Attorney, Agent, or Firm*—Katherine A. Nelson

[57] ABSTRACT

The filtered tap connector 10 includes a body member 12, having a pair of contact members 40 secured therein; a pusher member 50 receivable into a large recess 18 of the body member 12, the pusher member 50 having wire engaging surfaces 52 adapted to engage portions of wires 92 and urge them into electrical engagement with contact members 40; a pair of electrical components 60 of the type having a pair of spaced exterior electrodes 62, 64 disposed within cavities 26 of the body member 12 such that one of the component electrodes 62 is engaged with the corresponding contact member 40; and a biasing member 70 securable to the body member 12 remote from the large recess 18 and including a pair of arm portions 82 for engaging respective ones of the second 64 of the pair of electrodes 60, the biasing member 70 including a conductive path extending from component engaging surfaces 84 to an exposed outer surface portion and means for maintaining the biasing member 70 in the closed position. A pair of wire receiving channels 24 extend through the body member 12, along an inner-most surface of the large recess 18. Wire receiving sections 46 of the contact members 40 project outwardly into the large recess 18 transverse of the wire receiving channels 24. The biasing member 70 is movable between open and closed positions with respect to the body member 12.

8 Claims, 6 Drawing Sheets

U.S. PATENT DOCUMENTS 5,066,247 11/1991 Watson ..... 439/565
5,082,457 1/1992 Wollscheidt et al. ..... 439/620
5,087,212 2/1992 Hanami ..... 439/620
5,094,628 3/1992 Kano ..... 439/620
5,102,354 4/1992 Crane et al. ..... 439/620
5,112,253 5/1992 Swift ..... 439/620
5,141,454 8/1992 Garrett et al. ..... 439/620
5,141,455 8/1992 Ponn ..... 439/620
5,147,224 9/1992 Tan et al. ..... 439/620
5,151,054 9/1992 Briones et al. ..... 439/620
5,152,699 10/1992 Pfeifer ..... 439/620
5,158,482 10/1992 Tan et al. ..... 439/620
5,213,522 5/1993 Kojima ..... 439/620
5,221,215 6/1993 Tan et al. ..... 439/620
5,246,389 9/1993 Briones ..... 439/620
5,302,140 4/1994 Arnett ..... 439/557

EMI PROTECTED TAP CONNECTOR

FIELD OF THE INVENTION

This invention relates to electrical connectors, and more particularly, to filtered electrical connectors for protection against electromagnetic interference.

BACKGROUND OF THE INVENTION

Electrical circuitry often must be protected from disruptions caused be electromagnetic interference (EMI) entering the system. There are many applications where it is desirable to provide a connector with filtering capability, for example, to suppress EMI. Typically, these connectors include a housing having a plurality of electrical terminals and an electrical component associated with each of the terminals. The components include multi-layer ceramic capacitors or transient suppression diodes or the like, typically of the type having a pair of spaced external electrodes, which are soldered or adhered with conductive adhesive to circuit paths on a board incorporated within the connector. U.S. Pat. No. 4,729,752 discloses a connector having a circuit board with transient suppression diodes thereon. Other patents having components mounted on boards include U.S. Pat. Nos. 4,992,061 and 4,600,256. U.S. Pat. Nos. 5,151,054 and 5,152,699 disclose the use of ground springs for holding chip capacitors in electrical engagement with terminals in connectors.

For some applications, it is desirable to have means to provide filtering to an already existing electronic apparatus by use of a tap connector that can be mounted to an existing cable or wire as it enters an assembled apparatus to keep EMI from entering the apparatus, such as for example, telephone power and data lines where quick attachment is required. In addition the tap connector provides strain relief. When adding filtering to or retrofitting an existing apparatus, it is desirable to provide filtering at the bulkhead or panel rather than inside the apparatus thereby maintaining the integrity of the apparatus.

SUMMARY OF THE INVENTION

Accordingly, the present invention is directed to a filtered tap connector that alleviates problems associated with prior art. The filtered tap connector includes a body member, having a pair of contact members secured therein; a pusher member receivable into a large recess of the body member, the pusher member having wire engaging surfaces adapted to engage portions of wires and urge them into electrical engagement with contact members; a pair of electrical components of the type having a pair of spaced exterior electrodes disposed within cavities of the body member such that one of the component electrodes is engaged with the contact member; and a biasing member securable to the body remote from the large recess and including a pair of arm portions for engaging respective ones of the second of the pair of electrodes, the biasing member including a conductive path extending from component engaging surfaces to an exposed outer surface portion and means for maintaining the biasing member in the closed position. The body member includes a forward face and a rearward face with the large recess extending transversely thereinto from a peripheral surface. A pair of wire receiving channels extend through the body member, along an inner-most surface of the large recess. Wire receiving sections of the contact members project outwardly into the large recess transverse of the wire receiving channels. The biasing member is movable between open and closed positions with respect to the body member. In the preferred embodiment, the biasing member is a spring trapped between a pair of recesses in a manner to be compressed upon the biasing member being moved to an open position. The contact members of the tap connector establish electrical connection with the conductors of wires upon the pushing member urging wires into the wire receiving sections of the contact members and electrical circuits are defined from the contact members to the outer surface portion of the biasing member when such biasing member is urged into its closed position such that the arms are urged into the second electrodes of the respective electrical components thereby urging the components against the contact members with the first electrodes to establish electrical connection therewith. The device of the present invention is particularly suitable for mounting in a panel of a shielded system. Access to ground must be provided when the tap connector is used in an unshielded system.

It is an object of the invention to provide a filtered tap connector that is cost effective to manufacture and assemble.

It is also an object of the invention to provide a means for filtering EMI that maintains the integrity of the electronic assembly.

It is an additional object of the invention to provide a means for retrofitting existing electrical apparatus with filtering capability.

It is another object of the invention to provide a means for adding a capacitor to an apparatus in a quick and efficient manner.

An embodiment of the present invention will now be described in detail with reference to the accompanying drawings.

DETAILED DESCRIPTION OF THE DRAWINGS

Figure 1:
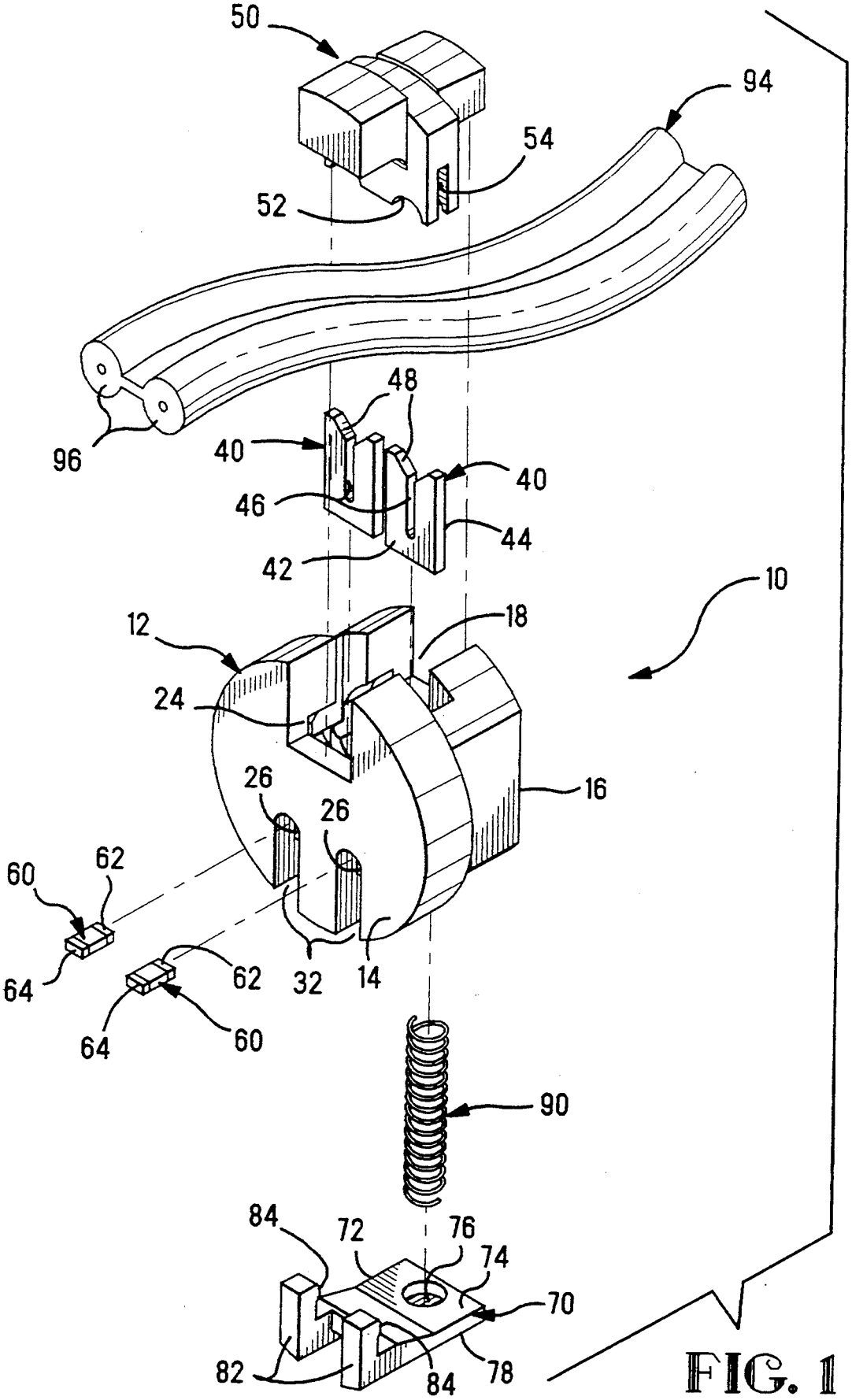
FIG. 1 is an exploded perspective view of the tap connector of the present invention.

Referring now to FIGS. 1, 2, 3 and 4, the filtered tap connector 10 of the present invention includes a dielectric body member 12, a pair of contact members 40, a dielectric wire pushing member 50, a pair of electrical components 60, a biasing member 70 and a spring member 90. FIG. 1 further shows a cable 94 having two wires 96 therein. For purposes of illustrating the invention, the tap connector is shown as a bushing. The wires have been omitted from FIGS. 2 through 5 for purposes of clarity.

Figure 2:
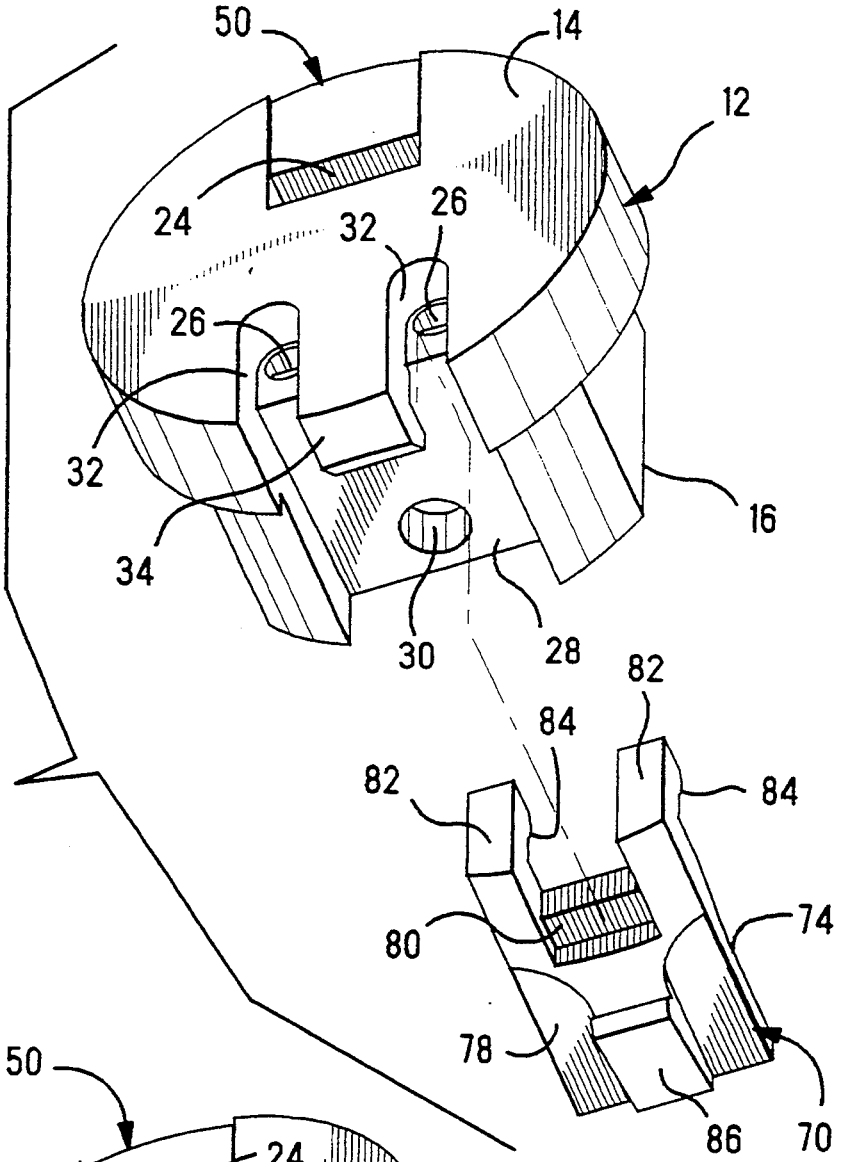
FIG. 2 is a partially assembled view of the connector of FIG. 1 with the biasing member exploded therefrom.
Figure 6:
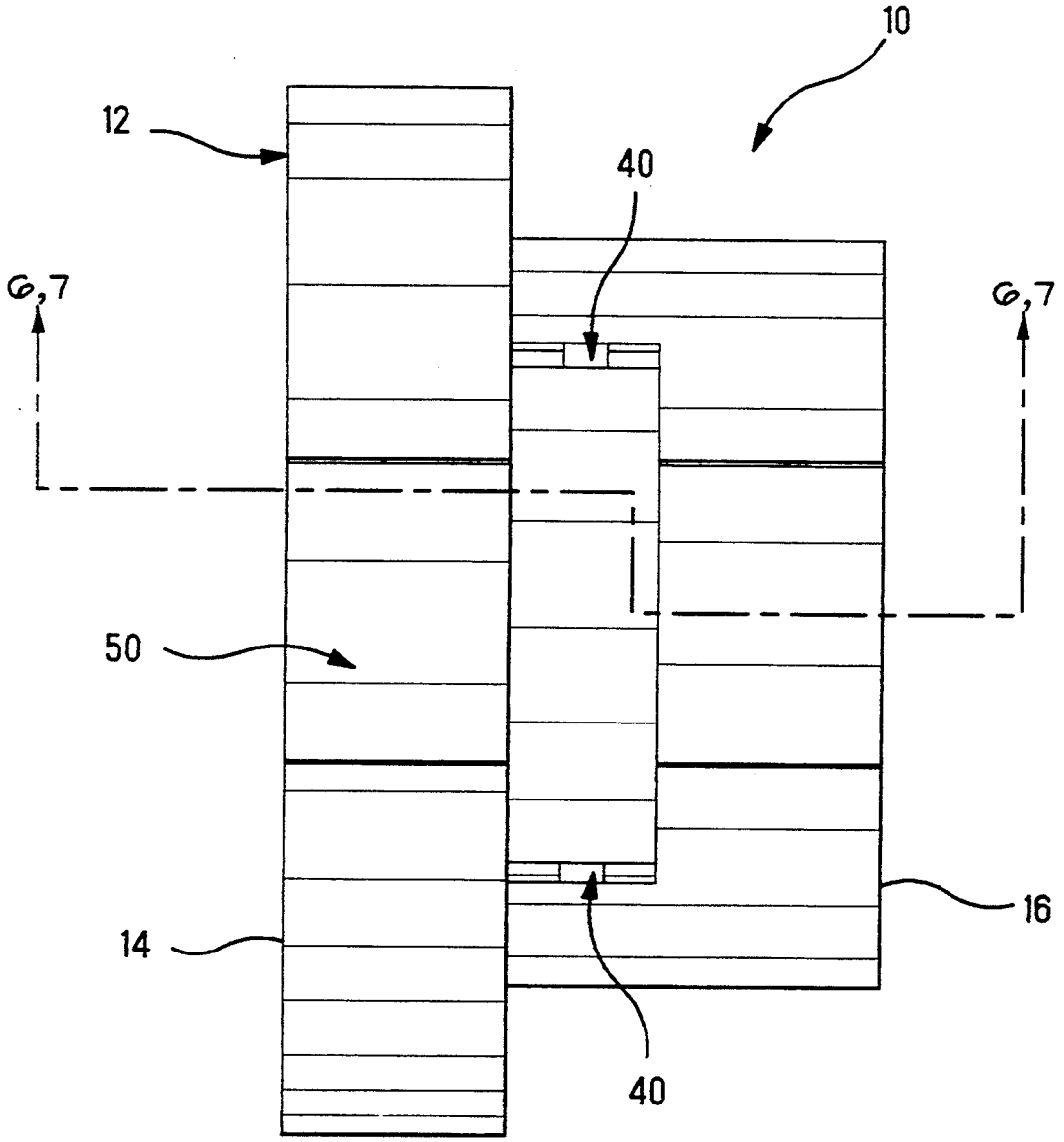
FIG. 6 is a side view of the connector illustrating the staggered cross sectioning line used for FIGS. 7 and 8.
Figure 7:
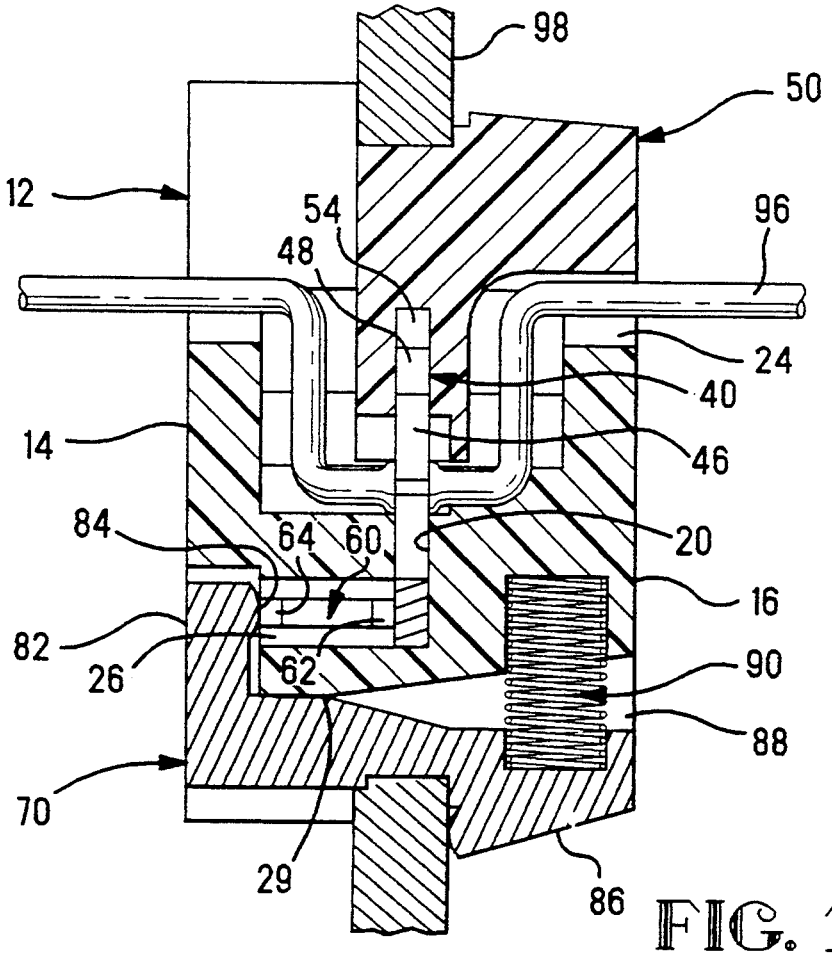
FIG. 7 is a cross-sectional view of the connector taken along line 7—7 of FIG. 6, the connector having a conductor extending therethrough and the biasing member in the closed position.

The dielectric body member 12 has a forward face 14, a rearward face 16, a large recess 18 extending transversely into the body from a peripheral surface thereof and a pair of electrical component receiving cavities 26 and a small recess 28 remote from the large recess and extending into the body from a peripheral surface thereof. The body member 12 further includes a spring receiving cavity as best seen in FIGS. 2, 6 and 7 extending into the body 12 from the small recess 28 remote from component receiving passageways. Body member 12 further includes a latch arm 32 extending into the small recess between the two component receiving cavities 26.

Figure 5:
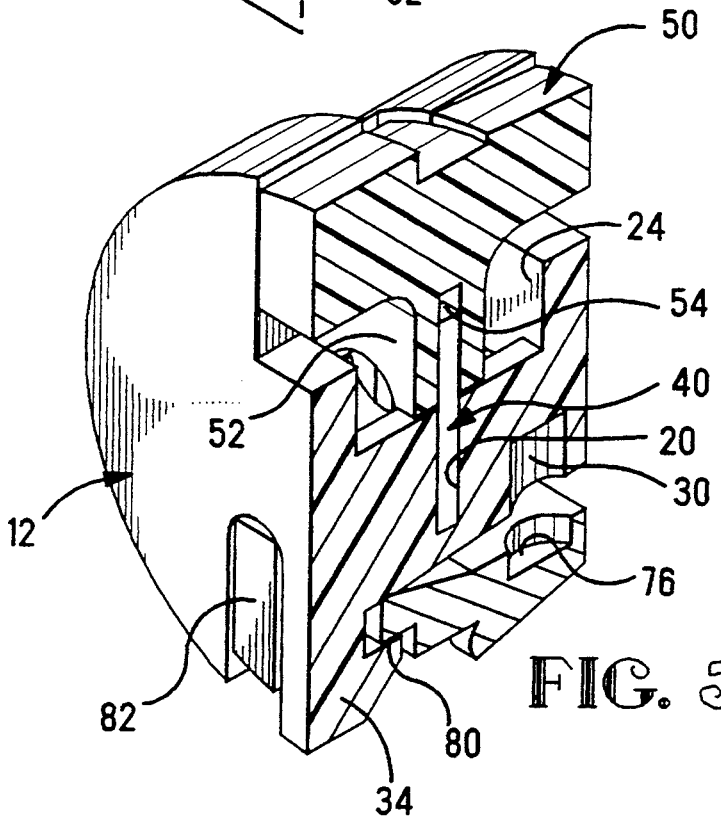
FIG. 5 is a cross-sectional view of the connector of FIG. 4.
Figure 8:
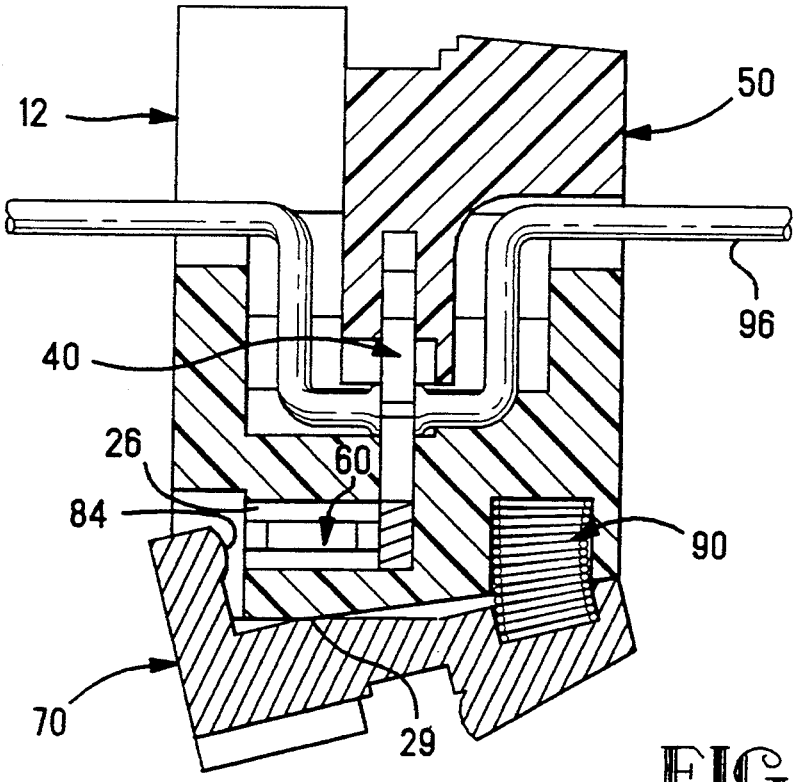
FIG. 8 is a cross-sectional view, taken along line 8—8 of FIG. 6, similar to that of FIG. 7, showing the biasing member in the open position.

Large recess 18 extends transversely into the body member 12 from a peripheral surface, and includes a pair of wire receiving channels 24 extending through body member 12 from the forward face 14 to the rearward face 16 and extending along an innermost surface of the large recess 18. The pair of contact members 40 are secured by friction fit within component receiving cavities 26 as best seen in FIGS. 5, 7 and 8. The contact members 40 are known in the art as insulation displacement contacts. Each contact member 40 includes a forward face 42 and a rearward face 44, and a wire receiving section 46 having chamfered lead-in edges 48. The pusher member 50 includes wire-engaging surfaces 52 and contact receiving slots 54. The component receiving cavities 26 are best seen in FIGS. 7 and 8. Component cavities 26 extend between the contact receiving cavities 20 and the small recess 28. The large recess 18 is configured to receive the cable 94 having a pair of continuous wires 92 extending through the wire receiving channels 24, upwardly extending wire receiving sections 46 of the contact members 40, and a portion of the pusher member 50 when the tap connector is fully assembled. Dielectric housing portions 12 and 50 may be made from a variety of materials, such as polyesters, polyphthalamides, and other suitable engineering resins as known in the art.

Figure 3:
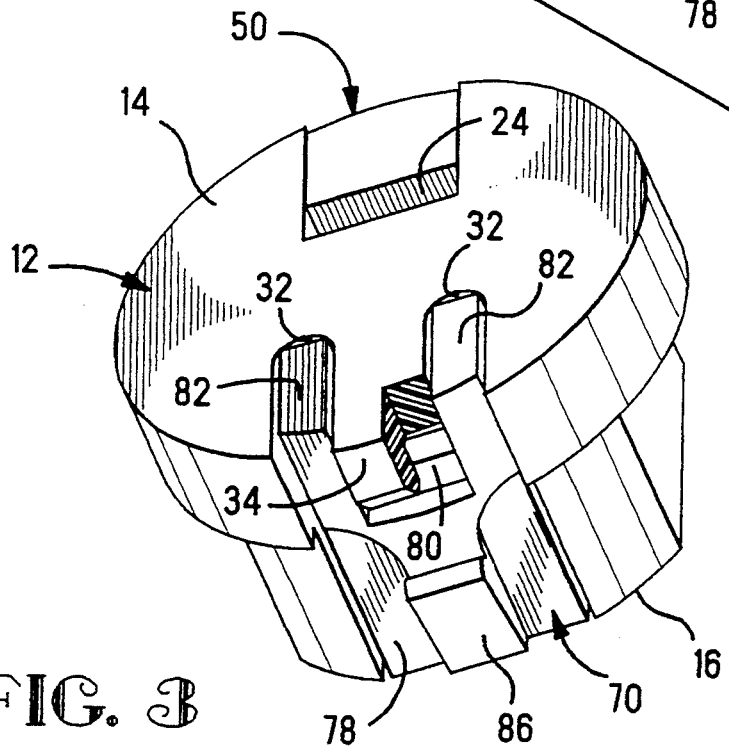
FIG. 3 is a view similar to that of FIG. 2 with the biasing member assembled to the housing and part of the housing broken away.
Figure 4:
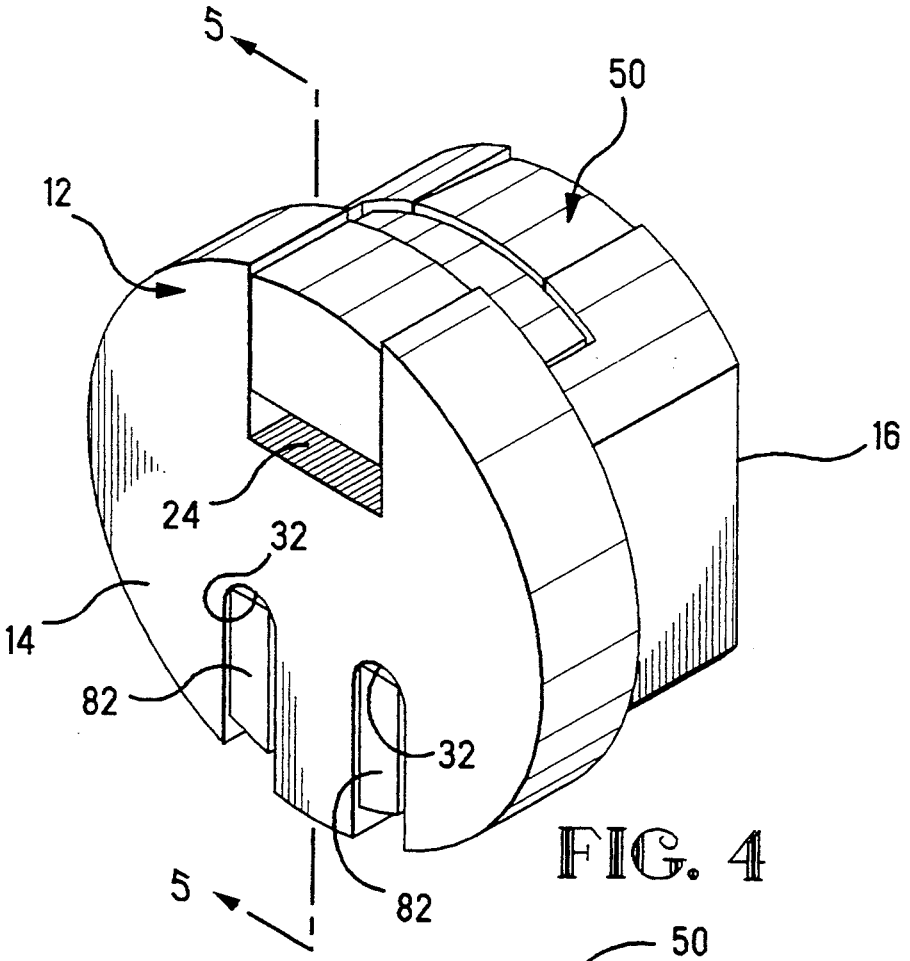
FIG. 4 is an assembled view of the connector of FIG. 1.

As can best be seen in FIGS. 2 and 3, the smaller recess 28 is configured to receive the biasing member 70. Biasing member 70 includes a body 72 having an inner surface 74 with a spring receiving recess or detente 76 thereon, an outer surface 78, a latching surface 80 as best seen in FIGS. 2 and 3 and a pair of upwardly extending arms 82 having component engaging surfaces 84 thereon. When the biasing member 70 is secured to the housing body member 12, the housing latch arm 34 engages the latch surface 80 of the biasing member as best seen in the broken away portion of FIG. 3. The arms 82 of the biasing member extend along the peripheral surface and into arm receiving channels 32 of recess 28. When in the closed position, the component engaging surfaces 84 of the arms 82 engage the second electrodes 64 of the electrical components 60 as best seen in FIGS. 7 and 8. In the preferred embodiment, the biasing member is formed of a conductive material such that upon assembly of the tap connector, the conductive component engaging surface 84 engages the electrode 64 and biases the component 60 against the contact member 40, thereby completing the electrical path between the outer surface portion of the biasing member to the contact and the wire.

Electrical components 60 are of the type having exposed electrodes 62, 64 at opposite ends thereof as best seen in FIGS. 1, 6 and 7. The components may be multilayered ceramic capacitors, diodes or other chip-like components as known in the art. The chip-like components are of dimensions of a few hundredths of an inch, such as, for example $0.08 \times 0.05 \times 0.04$ inches.

FIGS. 5, 7 and 8 show cross-sections of the assembled tap connector 10. FIG. 6 illustrates the sectioning line used for FIGS. 7 and 8. FIGS. 7 and 8 are staggered cross-sections illustrating the continuous wire as it extends through the tap connector. FIG. 5 is sectioned to illustrate the locking engagement of latch surfaces 80 and latch arm 34, and further shows the spring receiving cavity 30 and detente 74. The spring and wire members have been omitted from FIG. 5 for purposes of clarity. FIGS. 7 and 8 show the conductor 96 engaged in the wire receiving slots of the respective contact member 40 after the pusher member 50 has been fully inserted into the body member recess 18. FIG. 7 further shows the component engaging surface 84 of biasing member arm 82 in engagement with the second electrode 64 of electrical component 60. The first electrode 62 of component 60, is engaged with the forward face 42 of contact member 40. The spring member 90 is disposed between the spring receiving cavity 30 and the detente 76 of biasing member 70. As can be seen in FIG. 8, the biasing member 70 pivots at surface 29 recess 28 when the back portion 86 of biasing member 70 is depressed. FIG. 7 further shows that when the biasing member 70 is in the closed position, there is space between the outer surface of the small recess 28 and the inner surface 74 of the latch arm.

Figure 9:
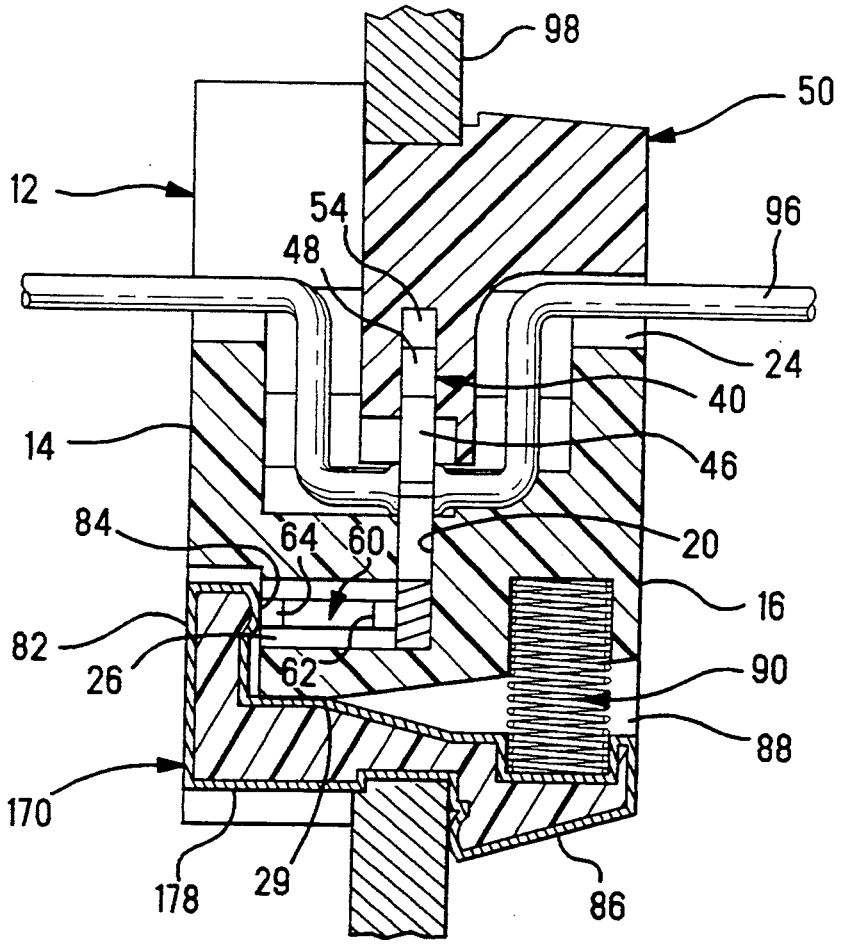
FIG. 9 is a cross-sectional view similar to FIG. 7 showing an alternative embodiment of the biasing member.

The biasing member 70 may be made from copper alloys such as brass or bronze that have been plated with a corrosion resistant conductive overplate. The bushing tap connector of the present invention can be mounted in a metal member such as a bulkhead or panel or otherwise connected to ground. In an alternative embodiment 170, shown in FIG. 9, the biasing member may be made from a non-conductive material such as a plastic that has been plated as at 178 on at least the outer surface and includes a conductive path between the outer surface to the component engaging surface 84.

The assembly and structure of the tap connector 10 is best understood by referring to FIGS. 7 and 8. The contact members 40 are inserted into respective contact receiving cavities 20 through the large recess 18 such that the wire receiving sections 46 extend into the large recess 18 transverse of the wire receiving channels 24. Components 60 are disposed within the respective component receiving cavities 26 and the spring member 90 and biasing member 70 are disposed in their respective positions. The cable or wires inserted into the large recess 18 and the pusher member 50 is urged against the wire such that the conductors engage in the contact by insulation displacement.

The present invention provides a filtered tap connector that eliminates the need for cutting wires to provide filtering for an electrical cable. The tap connector may be applied to a wire without special preparation of the wire or specialized tooling. The present invention further provides a means for strain relief of an existing cable as it exits an electronic assembly. The biasing member assures electrical connection between the ground through the component to the contact member.

It is thought that the filtered connector of the present invention and many of its attendant advantages will be understood from the foregoing description. It is apparent that various changes may be made in the form, construction and arrangement of the parts thereof without departing from the spirit or scope of the invention or sacrificing all of its material advantages.

We claim:

1. An electrical tap connector adapted for placement along a pair of continuous wires for filtering EMI for an electronic assembly comprising:

a body member having a forward face and a rearward face, a large recess extending transversely thereinto from a peripheral surface thereof, and a pair of wire receiving channels extending through said body member from said forward face to said rearward face and extending along an innermost surface of said large recess, said body member including a pair of contact members secured therein with wire receiving sections projecting outwardly into said large recess transverse of said wire receiving channels;

a pusher member receivable into said large recess from laterally of said body member and including a wire engaging surface adapted to engage portions of said wires and urge them into said wire receiving sections of said contact members;

a pair of electrical components receivable into respective cavities extending axially into said body member to respective said contact members, each said component having a pair of spaced exterior electrodes, the first of each of said pair of electrodes being engageable with said contact member;

a biasing member securable to said body member along a peripheral surface portion thereof remote from said large recess and movable between open and closed positions with respect thereto, said biasing member including a pair of arm portions, each arm portion engaging respective ones of the second of said pair of electrodes of said components when urged into said closed position in said body member, said biasing member at least including a conductive path extending from component engaging surfaces of said arms to an exposed outer surface portion; and means for maintaining said biasing member in said closed position, whereby said contact members establish electrical connection with conductors of said wires upon said pushing member urging said wires into said wire receiving sections and electrical circuits are defined from said contact members to said outer surface portion of said biasing member upon said biasing member being urged into said closed position such that said arms are urged into said second electrodes of respective said electrical components and urge said components against said contact members for said first electrodes to establish electrical connection therewith.

2. The electrical connector of claim 1 wherein said means for maintaining said biasing member in said closed position is a spring trapped between a pair of recesses in manner to be compressed upon said biasing member being moved to said open position.

3. The electrical connector of claim 2 wherein said biasing member is pivotal about an axis about said arms between said open and said closed positions.

4. The electrical connector of claim 3 wherein said cavities co-extend across said forward face to a peripheral surface portion and said arms of said biasing member are movable along said cavities across said forward face of said body member.

5. The electrical connector of claim 1 wherein said cavities co-extend across said forward face to a peripheral surface portion and said arms of said biasing member are movable along said cavities across said forward face of said body member.

6. The electrical connector of claim 1 wherein said biasing member is formed of conductive material.

7. The electrical connector of claim 1 wherein said biasing member is plated to have at least a conductive outer surface.

8. The electrical connector of claim 1 wherein when said biasing member is in said closed position, said biasing member is configured to fit within a general outer envelope defined by said body member.

* * * * *